219-121 SR
8/26/80 XR 4,219,726

United States Patent [19]
Meyer et al.
[11] 4,219,726
[45] Aug. 26, 1980

[54] ARC HEATER CONSTRUCTION WITH TOTAL ALTERNATING CURRENT USAGE

[75] Inventors: Thomas N. Meyer, Murrysville; Charles B. Wolf, Irwin, both of Pa.

[73] Assignee: Westinghouse Electric Corp., Pittsburgh, Pa.

[21] Appl. No.: 24,940

[22] Filed: Mar. 29, 1979

[51] Int. Cl.² ..... H05B 7/18
[52] U.S. Cl. ..... 219/383; 219/74; 219/121 R; 219/123; 313/156; 313/231.4
[58] Field of Search ..... 219/74, 75, 121 R, 121 P, 219/123, 383; 313/32, 156, 231.3, 231.4; 315/111

[56] References Cited

U.S. PATENT DOCUMENTS

| | | | |
|---|---|---|---|
| 3,629,553 | 12/1971 | Fey et al. | 219/383 |
| 3,705,975 | 12/1972 | Wolf et al. | 219/383 |
| 3,760,151 | 9/1973 | Wolf et al. | 219/383 |
| 3,832,519 | 8/1974 | Wolf et al. | 219/121 P |
| 3,953,705 | 4/1976 | Painter | 219/121 P |
| 4,042,802 | 8/1977 | Fay et al. | 219/121 P |

*Primary Examiner*—Volodymyr Y. Mayewsky
*Attorney, Agent, or Firm*—L. P. Johns

[57] ABSTRACT

Arc heater apparatus using total alternating current characterized by a pair of axially spaced cylindrical electrodes forming a narrow gap therebetween and connected to a first alternating current power source to produce an arc in the gap, each electrode having magnetic coil means for producing a rotating magnetic field at the arcing surface of the electrodes to rotate the arc, and the magnetic coil means being connected to a second alternating current power source which has an arc current zero aligned with that of the first alternating current power source.

6 Claims, 3 Drawing Figures

ARC HEATER CONSTRUCTION WITH TOTAL ALTERNATING CURRENT USAGE

BACKGROUND OF THE INVENTION

1. Field of the Invention

This invention relates to an arc heater which is completely powered by alternating current.

2. Description of the Prior Art

Arc heaters of prior construction required alternating current (AC) and direct current (DC) power. The AC power was carried by the arc heater tubes or electrodes, for generating and maintaining an arc extending between the electrodes. The DC power energized field coils surrounding the tubular electrodes to provide a magnetic field around the electrodes. The DC coil current resulted in a DC magnetic field which is mainly oriented along the axis of the tubular electrodes. The interaction of the axial field with the radial current component resulted in rapid rotational arc movement (about 1,000 cycles/second). Such rapid arc movement leads to an extended electrode life and a more effective heat exhange between the high temperature arc and the cold gas to be heated. However, the DC field does not provide equal heating over both ½ cycles of the AC arc current. Moreover, gas is preferably admitted tangentially between the upstream and downstream electrodes so that under DC field conditions, the arc moved with and against the rotational direction of the entering gas. That condition was mainly responsible for the polarity-dependent heating and/or voltage characteristics of arc heaters of prior construction.

SUMMARY OF THE INVENTION

In accordance with this invention it has been found that certain disadvantages of arc heaters of prior construction may be overcome by providing a magnetic field that alternates with the arc current so that arc rotation moves continuously against or with the rotation of the entering gas flow. As a result the arc continuously rotates in the same direction. For that purpose it is proposed to operate the field coil by AC power, and to correct the phase of the current to optimally align field zeros with the arc current zeros.

The advantage of an arc heater using only alternating current power source is to provide rotational arc motion in one direction to achieve improved heating efficiency as well as extended electrode life. In addition a need for DC power supply is eliminated.

DESCRIPTION OF THE PREFERRED EMBODIMENT

Figure 1:
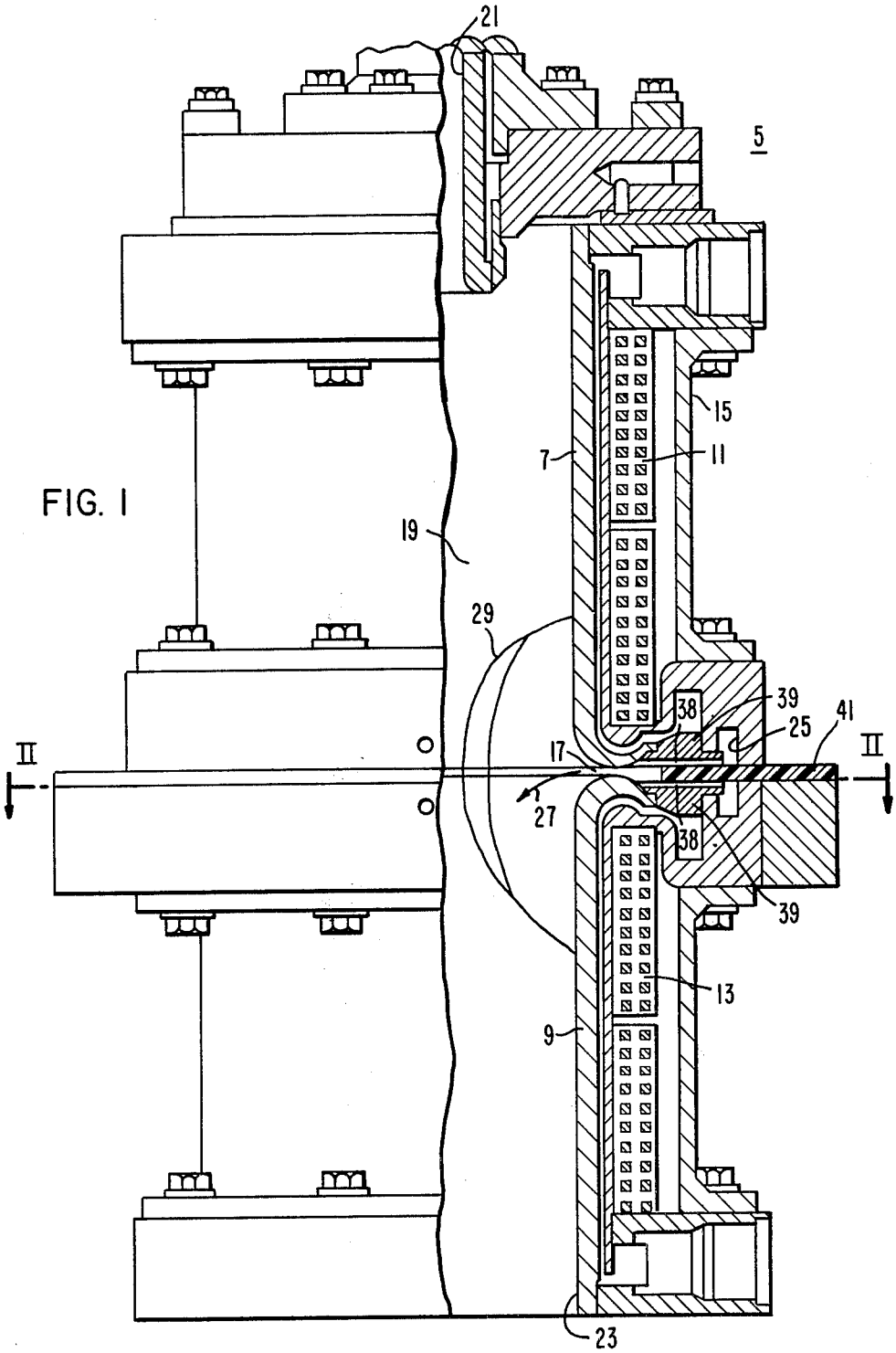
FIG. 1 is an elevational view, partially in section of an arc heater of that type involved in this invention.

In FIG. 1 an arc heater is generally indicated at 5 and comprises a pair of axially spaced tubular electrodes 7, 9, field coils 11, 13, and an outer housing 15 surrounding the electrodes and coils. The electrodes 7, 9 are spaced by a gap 17 about one millimeter apart to accommodate an alternating current power source of about 4 kV. The tubular or cylindrical electrodes 7, 9 define an arc chamber 19 which extends in opposite directions from the gap 17 and includes an inlet port 21 at the upper end an outlet port 23 at the lower end.

The gap 17 communicates with passage means including a gas manifold 25 by which incoming stock gas 27 is introduced through the gap into the arc chamber 19. The high velocity gas 27 blows an arc, initiated in the gap 17, into the arc chamber 19 to form an extended arc 29 having an upper end on the electrode 7 and a lower end on the electrode 9.

The arc heater 5 is similar in construction and operation to that disclosed in U.S. Pat. No. 3,705,975, entitled "Self-Stabilization Arc Heater Apparatus" of which the inventors are Charles B. Wolf and Maurice G. Fey. The arc heater 5 is preferably operated but not limited to operation on AC power. It is capable of power levels up to and exceeding 3,500 kilowatts to provide and maintain the arc 29. Under satisfactory operating conditions the injected gas 27 is heated by the arc 29 to temperatures typically in the range of 3000° C. to 4000° C. to form a gas stream or jet which issues downwardly through the open end 23 of the arc heater.

Figure 3:
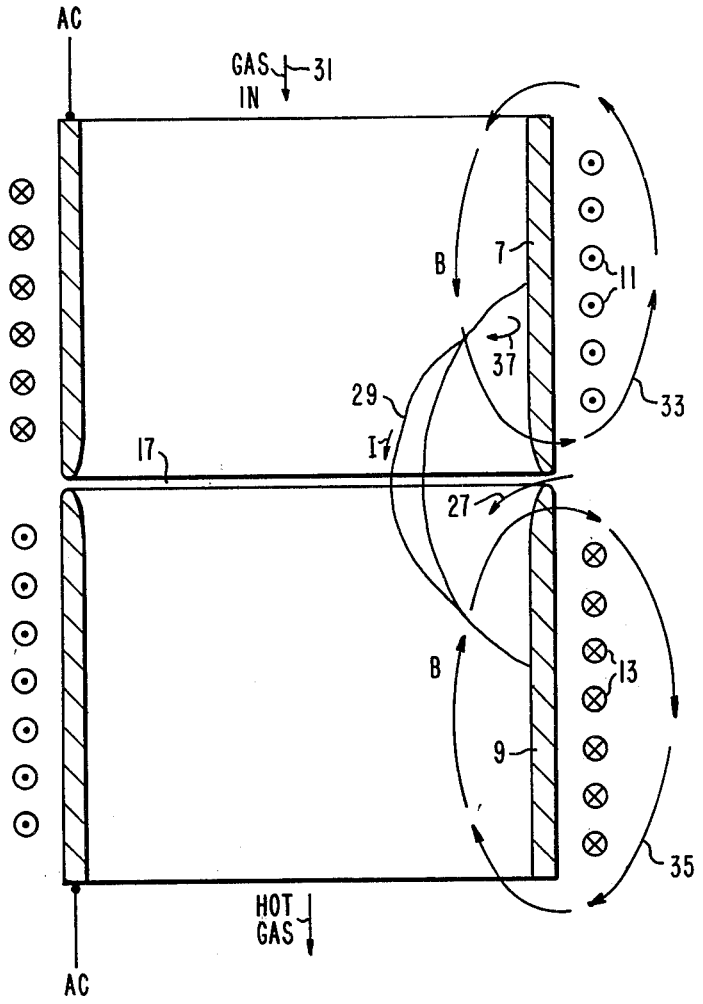
FIG. 3 is a schematic view showing the interrelationship between the arc heater electrodes, the coils, and the arc.

In accordance with this invention, the field coils 11, 13 are powered by a phase adjusted AC power source. FIG. 3 illustrates a cross-sectional view of upstream and downstream electrodes 7, 9, the direction 31 of gas flows, and magnetic fields 33, 35 for field coils 11, 13, respectively. In addition, FIG. 3 shows the direction of current in the field coils, and the current-carrying arc 29 during the ½ cycle where the upstream electrode 7 is the anode, and the direction 37 of arc movement resulting from the $I \times B$ force. When the arc current changes direction (i.e. the other ½ cycle), the arc current and the coil current will both reverse directions; however, the rotational direction of the cold gas entering remains the same.

Operation of the field coils 11, 13 on AC current in phase with the arc current will produce magnetic fields 33, 35 which lag the arc current and their magnitude is reduced by the current induced in the electrodes 7, 9. Experimentally the magnetic field has been found to lag the coil current by 60°. Using the coil and electrode geometry, and analysis predicts the observed phase angle.

Accordingly, it is proposed that the field coil be operated at AC currents comparable to those used under DC coil operation but having applied circuitry to adjust the magnetic field zeros to be aligned with the arc current zeros. A separate analysis indicates reasonable capacitors (e.g., 0.1 farads at 200 volts) can be used to make the phase adjustment of the field coil current relative to the arc current phase angle. However, other means may be utilized including a phase controlled motor generator set, a phase adjusted solid state AC power supply, combinations of generators and inductors applied at selected points of an AC voltage source (1Φ), and/or taking advantage of phase differences available from 3Φ supplies to minimize electrical components required.

In summary, many straight forward means are available to adjust the phases. Due to the magnetic field decrease, higher coil currents may be required to produce the same field obtained by DC coil power. However, there is a potential for extended electrode life and greater thermal heating efficiency.

Figure 2:
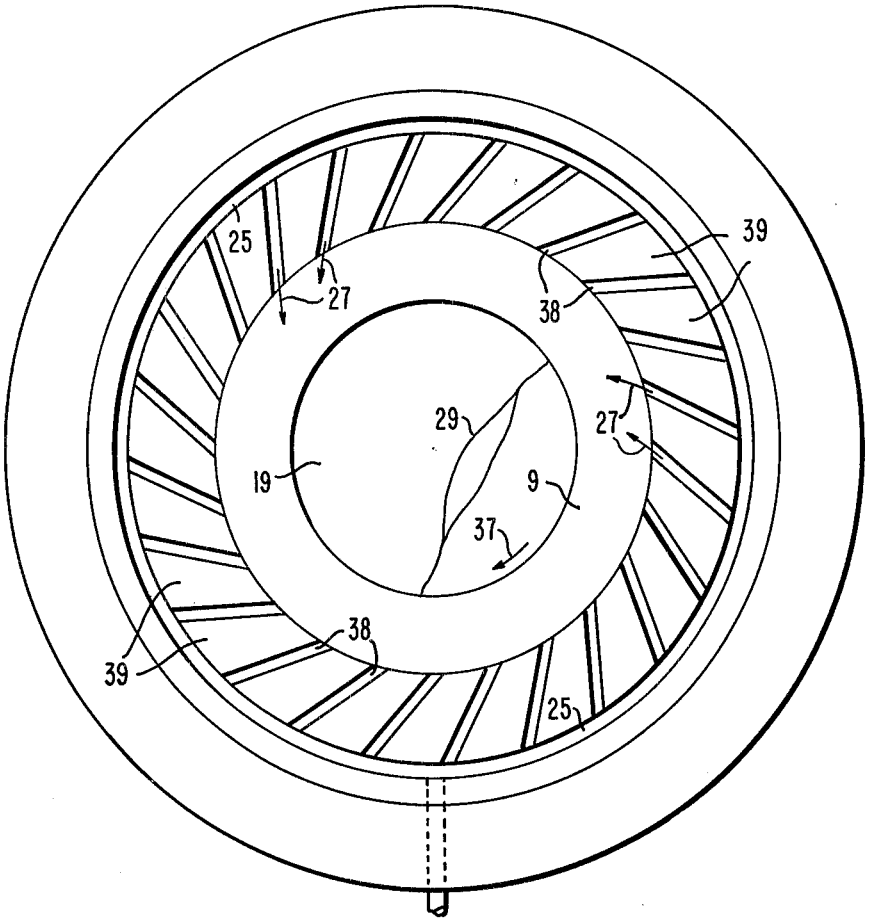
FIG. 2 is a horizontal sectional view taken on the line II—II of FIG. 1.

As shown in FIG. 2, there are means for spacing and electrically insulating the electrodes 7, 9 from each other which means comprise an insulating ring 41 between metal swirl rings 39. By varying the flow rate and direction of flow in the gap 17, it is possible to achieve a high or low net swirl at the outlet port 23 by providing the rings 39 having a plurality of peripherally spaced tangentially extending slots 38 through which the gas 27 passes from the manifold 25 to the arc chamber 19 in a tangential direction rather than radially. Although the swirling motion may not be desirable for all processes for which the arc heater is used, it is useful in that it is effective in promoting rapid arc extension into the arc chamber. The gases react within the arc chamber 19 in conjunction with the arc 37.

In conclusion, where the tangential gas flow and the AC arc move in the same direction for the given power supply there is a maximum utilization of power and heating effect.

What is claimed is:

1. Arc heater apparatus comprising means defining an arc chamber and including a pair of axially spaced cylindrical electrodes forming a narrow gap therebetween and connected to a first AC power source to produce an arc in the gap, means spacing and electrically insulating the electrodes from each other and comprising means for channeling gas to be heated at a high velocity to the gap, the arc chamber extending in opposite directions from the gap and having an inlet end and an outlet end, each of the electrodes having magnetic coil means for producing a magnetic field at the arcing surface of the electrodes to rotate the arc, and the magnetic coil means also being connected to a second AC power source thereby producing a magnetic field zero being controlled relative to that of the first AC power source.

2. The arc heater of claim 1 in which the arc rotates in one direction.

3. The arc heater of claim 2 in which the gas is injected into the arc chamber tangentially.

4. The arc heater of claim 3 in which the gas is injected tangentially in a direction corresponding to that of rotation of the arc.

5. The arc heater of claim 3 in which the gas is injected tangentially in a direction opposite to that of rotation of the arc.

6. The arc heater of claim 1 in which there are means for phase adjustment of field coil current relative to the arc current phase angle.

* * * * *